US007073205B2

(12) United States Patent
Finn

(10) Patent No.: US 7,073,205 B2
(45) Date of Patent: Jul. 11, 2006

(54) APPARATUS FOR HOLDING A PAINT CAN EMPLOYING A GLOVE AND SLEEVE

(76) Inventor: Randall Finn, P.O. Box 717, Oxford, GA (US) 30054

( * ) Notice: Subject to any disclaimer, the term of this patent is extended or adjusted under 35 U.S.C. 154(b) by 119 days.

(21) Appl. No.: 10/786,408

(22) Filed: Feb. 25, 2004

(65) Prior Publication Data

US 2005/0193463 A1 Sep. 8, 2005

(51) Int. Cl.
*A41D 19/00* (2006.01)

(52) U.S. Cl. ..... 2/160; 2/159; 2/161.6; 2/162

(58) Field of Classification Search ..... 2/159, 2/160, 161.5, 161.1, 161.2, 161.4, 161.6; 24/3.1, 599, 163, 578; 220/500, 904, 507, 220/284; 206/373, 284
See application file for complete search history.

(56) References Cited

U.S. PATENT DOCUMENTS

| | | | | |
|---|---|---|---|---|
| 1,583,041 A | | 5/1926 | Herrick | |
| 4,246,944 A | | 1/1981 | Dixie | |
| 4,414,692 A | * | 11/1983 | Dzierson et al. | 2/160 |
| 4,736,488 A | | 4/1988 | Nielsen | |
| 4,862,521 A | * | 9/1989 | Mann | 2/160 |
| 4,993,551 A | * | 2/1991 | Lindsay | 206/373 |
| 5,020,710 A | | 6/1991 | Meszaros | |
| 5,088,123 A | * | 2/1992 | MacDonald | 2/162 |
| 5,385,281 A | | 1/1995 | Byrd | |
| 5,471,681 A | | 12/1995 | Ferrini | |
| 5,570,807 A | | 11/1996 | Busch | |
| 5,806,709 A | | 9/1998 | Marshall, II | |
| 5,833,095 A | * | 11/1998 | Russell et al. | 224/576 |
| 6,000,058 A | * | 12/1999 | Iselin | 2/160 |
| 6,019,245 A | | 2/2000 | Foster | |
| 6,085,902 A | | 7/2000 | Fang | |
| 6,382,691 B1 | | 5/2002 | Hazelton | |

* cited by examiner

*Primary Examiner*—John J. Calvert
*Assistant Examiner*—Alissa J. Tompkins
(74) *Attorney, Agent, or Firm*—Joseph G. Mitchell, Esq.

(57) ABSTRACT

This invention provides an apparatus for steadily holding a bucket or paint can. The invention is designed to reduce the stress to a user's thumb, hand, and wrist that occurs when a user holds a bucket over a period of time. The apparatus comprises a glove sewn to a sleeve. The sleeve of the invention supports the bucket or paint can from all sides, including the bottom, so the user does not even have to touch the bale handle of the bucket or paint can. Two adjustable heavy duty wide straps are also provided for better support of the sleeve. Two wrist straps are also provided to adjust the hand compartment of the glove and support the user's wrist. The method of the present invention includes donning the glove about the hand and tightening it with the wrist straps and then using the device to hold the bucket or paint can within the sleeve.

7 Claims, 4 Drawing Sheets

1
2
3
4
9
23
19
18
17
7
24
20
11
12'
28
25
10
26
7
27
9
4
6

APPARATUS FOR HOLDING A PAINT CAN EMPLOYING A GLOVE AND SLEEVE

BACKGROUND OF THE INVENTION

1) Field of the Invention

The field of invention relates to an apparatus for holding a bucket and more particularly a paint can. Specifically, the invention provides for an easy and economical means of holding a paint can so as to greatly reduce or eliminate the stress on a user's thumb, hand, and wrist.

2) Description of Prior Art

Recent studies have shown increased focus has been placed on the effects of cumulative stress disorders ("CTDs"), such as carpal tunnel syndrome, tendonitis, ganglion cysts and the like, that cause worker pain and discomfort which results in lower productivity. Extensive studies have shown that these disorders affect many types of workers; for example, computer operators, secretaries, certain machine workers, postal workers and a host of other types of workers are affected by CTDs. In particular, these problems exist for painters who must hold paint cans, with a bale handle, for 8 to 12 hours a day. Most painters hold the paint can in one hand with fingers of the same hand against the container's bottom to support the container and with the bale handle generally against the side of the container, so it is easy to access the paint inside the paint can. To stabilize the container, painters hook their thumb over the bale handle. Holding the container, as just described, for a long period, such as when a painter is "cutting in" (e.g., bordering the walls of a room) or doing trim work, can result in accumulated stress to the heel area of the hand, in the thumb across the palm of the hand, across the transverse carpal ligament, or cause carpal tunnel syndrome. The accumulated loads and stresses to one or several of these areas can lead painters to experience chronic fatigue, soreness, and pain leading to CTDs.

Several attempts have been made to overcome these problems. For example, in U.S. Pat. No. 5,570,807 to Busch, a user's thumb is inserted into a sleeve and the sleeve is fastened to the bucket. However, the stress on such user is much more pronounced than in the present invention. In another example, U.S. Pat. No. 5,806,709 to Marshall II, a handle is used to support the paint can. But again, the stress on the user while using this invention is much more prominent than in the present invention.

A need, therefore, exists for an apparatus that could be used by a painter needing to steadily hold a paint can and eliminate the pain associated with prior products. The present invention allows the person to steadily hold the container with decreased stress to one or several of the aforementioned areas of the hand and wrist. The present invention eliminates the need for the user to use his thumb to stabilize the container. The present invention gives support to the user's wrist to assist the user in holding the container from the container's bottom. This apparatus, of the present invention, provides further benefit by providing a convenient way to steadily hold the container in one hand and eliminates the need to bend to dip the paint brush, allowing the painter to do his work more rapidly and efficiently and with less accidental dripping. An added safety benefit of the present invention allows the painter to easily hold the container while standing on a ladder, or the like, thus allowing the painter to easily maintain balance on the ladder. The invention is designed to reduce or eliminate the need for the painter to rest the container on the ladder tray and by reducing or eliminating this need, the user is not placed in an off-balance position to access the container on the tray.

SUMMARY OF THE INVENTION

The purpose of the invention, then, is to provide a better and easier method to hold a paint can, so as to eliminate stress on the user, and design it better than what is currently on the market.

A brief summary of the invention follows. The invention is an apparatus for steadily holding a bucket or paint can. It is specifically designed to reduce the stress to a user's thumb, hand, and wrist that occurs when a user holds a bucket over a long period of time. The apparatus comprises a glove sewn to a sleeve. The sleeve of the invention supports the bucket or paint can from all sides, including the bottom, so the user does not even have to touch the bale handle of the bucket or paint can. Two adjustable heavy duty wide straps are also provided for better support of the sleeve. Two wrist straps are also provided to adjust the hand compartment of the glove and support the user's wrist. The method of the present invention includes placing the user's hand inside the glove, tightening the glove with the wrist straps and using the device to hold the bucket or paint can within the sleeve.

The invention resides not in any one of these features per se, but rather in the particular combination of all of them herein disclosed and claimed, and it is distinguished from the prior art in this particular combination of all its structures for the functions specified.

There has thus been outlined, rather broadly, the important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

One objective of this invention, then, is to allow a user to easily make use of the invention.

A further objective of the invention is to provide an apparatus that reduces the stress in a user while the user paints.

Yet another objective of the invention is to provide a device that is better designed than that that is currently on the market.

Another objective of the invention is to provide a device that is acceptable to the buying public.

Another objective of the invention is to allow for an economical device that is both easy to build and make.

BRIEF DESCRIPTION OF THE DRAWINGS

The invention will be better understood based on the following detailed description. Such description makes reference to the annexed drawings wherein.

DESCRIPTION OF THE PREFERRED EMBODIMENT

With reference now to the drawings, and in particular FIGS. 1, 2, 3, and 4, the drawings show therein the principles and concepts of the present invention.

Figure 1:
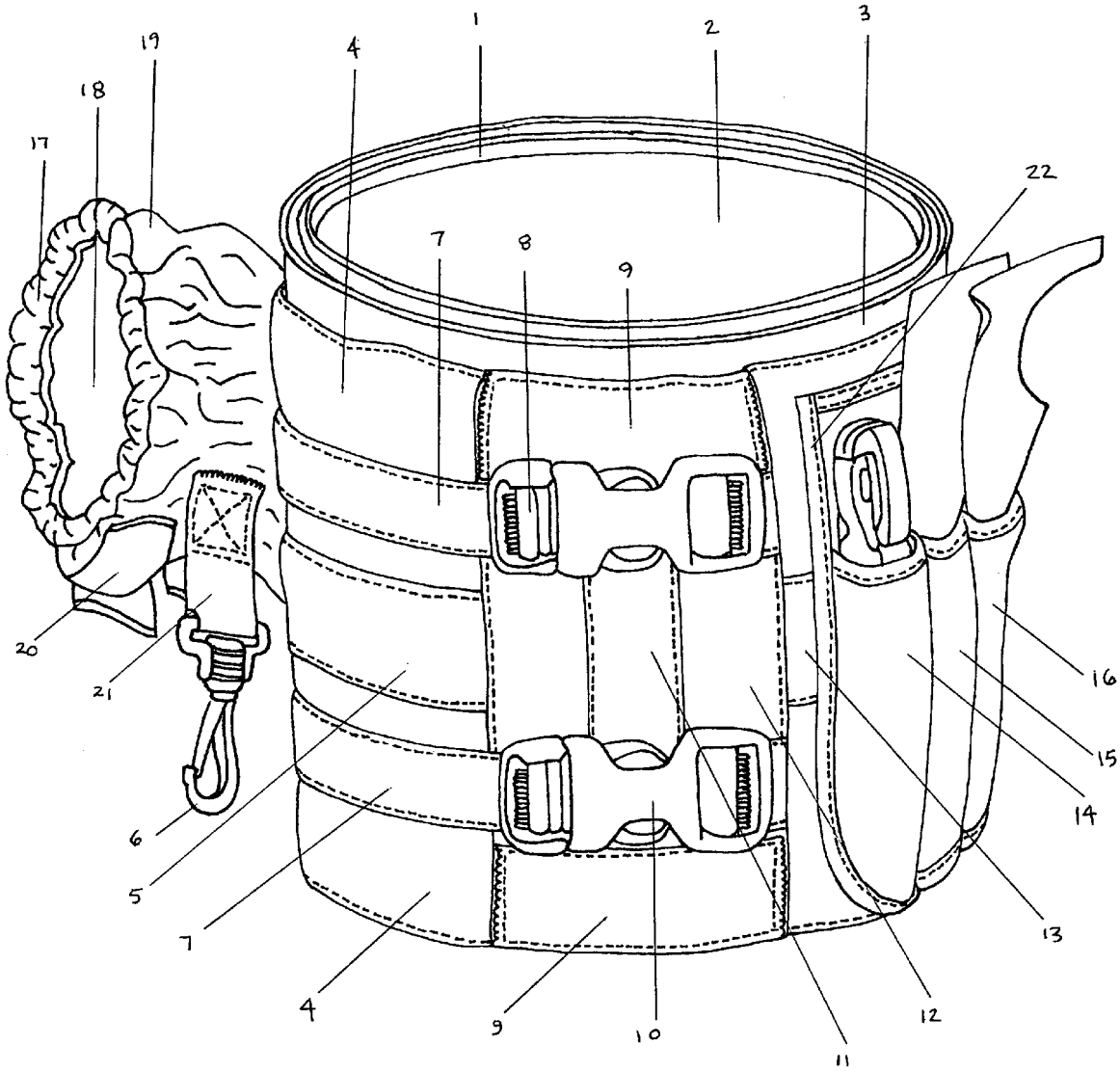
FIG. 1 shows a perspective view of the invention, with the paint can already in place showing the strap clips already snapped for added support around the paint can, also the three tool pouch holders for the most commonly used tools (painter's razor, lock blade, one inch putty knife, and 5 in 1 tool). The swivel snap clip for hanging the invention up after use or hooking the invention to the painter's belt loops for easy carrying.

With reference to FIG. 1, the invention comprises an elastic sleeve 4 that provides an opening at the top for receiving a bucket or paint can 1. The bucket or paint can 1 provides an opening 2 and the outside portion 3 of the bucket or paint can 1 fits against the inside area of the elastic sleeve 4. A heavy duty strap 5 which is about ¾ inches wide is added to support of the elastic sleeve 4. A swivel safety clip 6 is provided for hanging the apparatus up after use or hanging to the user's belt loop for carrying around. Heavy duty straps 7 which are about ¾ inches wide are also added to support the elastic sleeve 4. Locking snap clips 8 are provided at the end of the heavy duty straps 7 for easy tightening of the elastic sleeve 4 around the bucket or paint can 1 and when unsnapped, they will loosen and allow the user to pull out the bucket or paint can 1 from the elastic sleeve 4. A heavy duty strap 9 which is about 1 inch wide is provided at the top and bottom of the elastic sleeve 4 at where the of the locking snap clips 8 are located. Female locking clips 10 are provided at the opposite end of the heavy duty straps 7 and mate with the locking snap clips 8. A vertical heavy strap 11 which is about ¾ inch wide for added support for connection of the elastic sleeve 4 ends so that the elastic sleeve 4 forms a circle for receipt of the bucket or paint can 1. Another heavy duty strap 12 which is about 1 inch wide is added for support and this heavy duty strap 12 is vertically positioned. An additional heavy duty strap 13 which is about 1 inch wide is provided and it goes completely around the elastic sleeve 4 for added support. Three pouches, 14, 15, and 16 are sewn to the elastic sleeve 4 provided for receiving tools (especially painter's tools such as a lock razor knife, a putty knife and a 5 in 1 tool or a painter's number 1 tool). There is a glove attached to the elastic sleeve 4. There is an outside rim 17 of the glove, an opening 18 for the hand for the glove, and an outside wrist area 19 of the glove. Two heavy duty adjustable straps 20 which are about 1 inch wide are located at the back of the glove near the outside wrist area 19 of the glove. Another strap 21 which is about 1 inch wide is attached to the bottom of the outside wrist area 19 of the glove and it connects to the swivel safety clip 6. A heavy duty pouch 22 with three tool holders are sewn onto the elastic sleeve 4.

Figure 2:
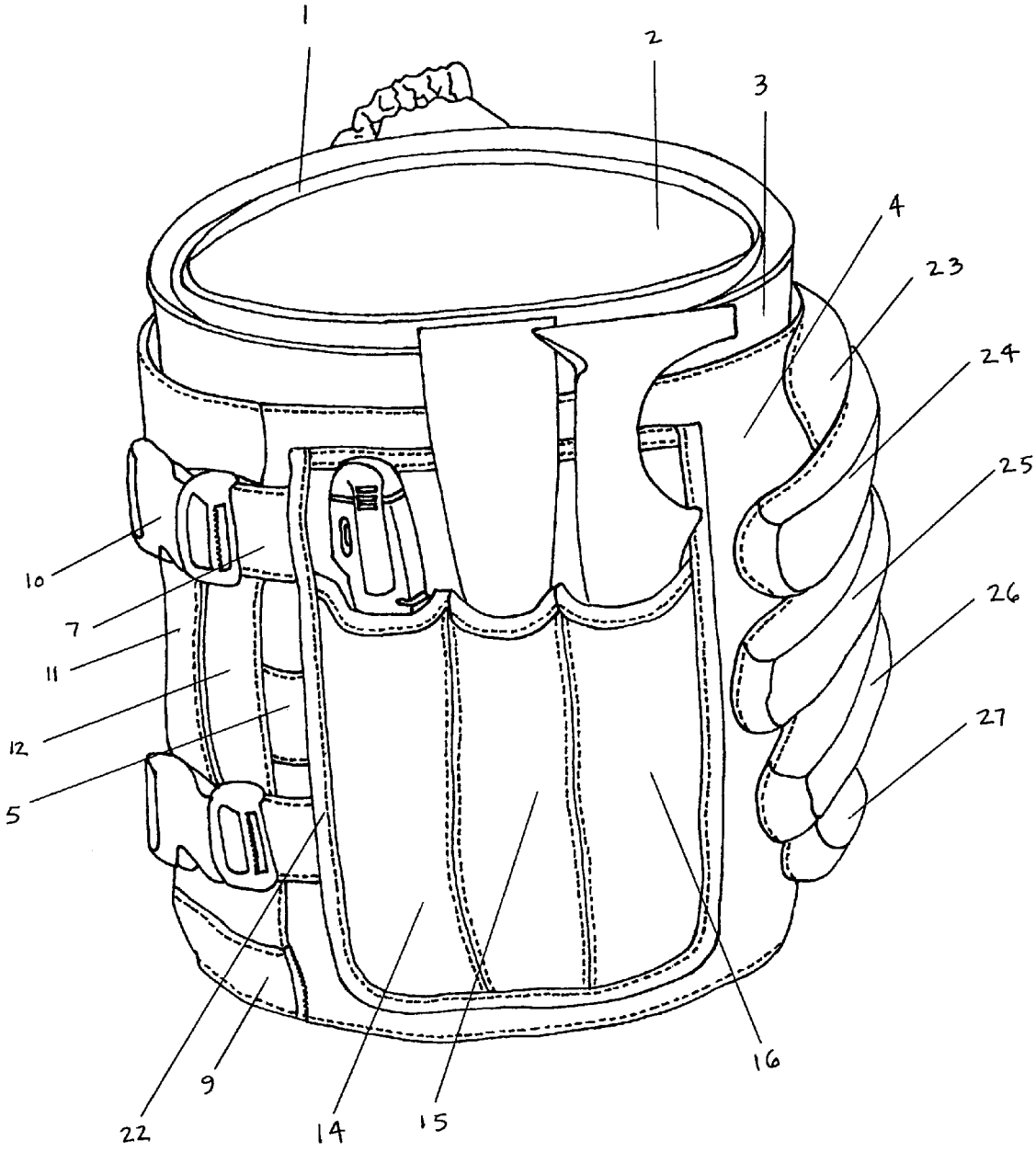
FIG. 2 shows a perspective view of the present invention but it shows a front angle of the fingers of the glove attached to the sleeve, such sleeve covers the entire paint can, except for the top of the can.

With reference to FIG. 2, the invention comprises an elastic sleeve 4 that provides an opening at the top for receiving a bucket or paint can 1. The bucket or paint can 1 provides an opening 2 and the outside portion 3 of the bucket or paint can 1 fits against the inside area of the elastic sleeve 4. A heavy duty strap 5 which is about ¾ inches wide is added to support of the elastic sleeve 4. Heavy duty straps 7 which are about ¾ inches wide are also added to support the elastic sleeve 4. A vertical heavy strap 11 which is about ¾ inch wide for added support for connection of the elastic sleeve 4 ends so that the elastic sleeve 4 forms a circle for receipt of the bucket or paint can 1. Another heavy duty strap 12 which is about 1 inch wide is added for support and this heavy duty strap 12 is vertically positioned. Three pouches, 14, 15, and 16 are sewn to the elastic sleeve 4 provided for receiving tools (especially painter's tools such as a lock razor knife, a putty knife and a 5 in 1 tool or a painter's number 1 tool). There is a glove attached to the elastic sleeve 4. A heavy duty pouch 22 with three tool holders are sewn onto the elastic sleeve 4. The glove has finger holes at 23, 24, 25, 26, and 27.

Figure 3:
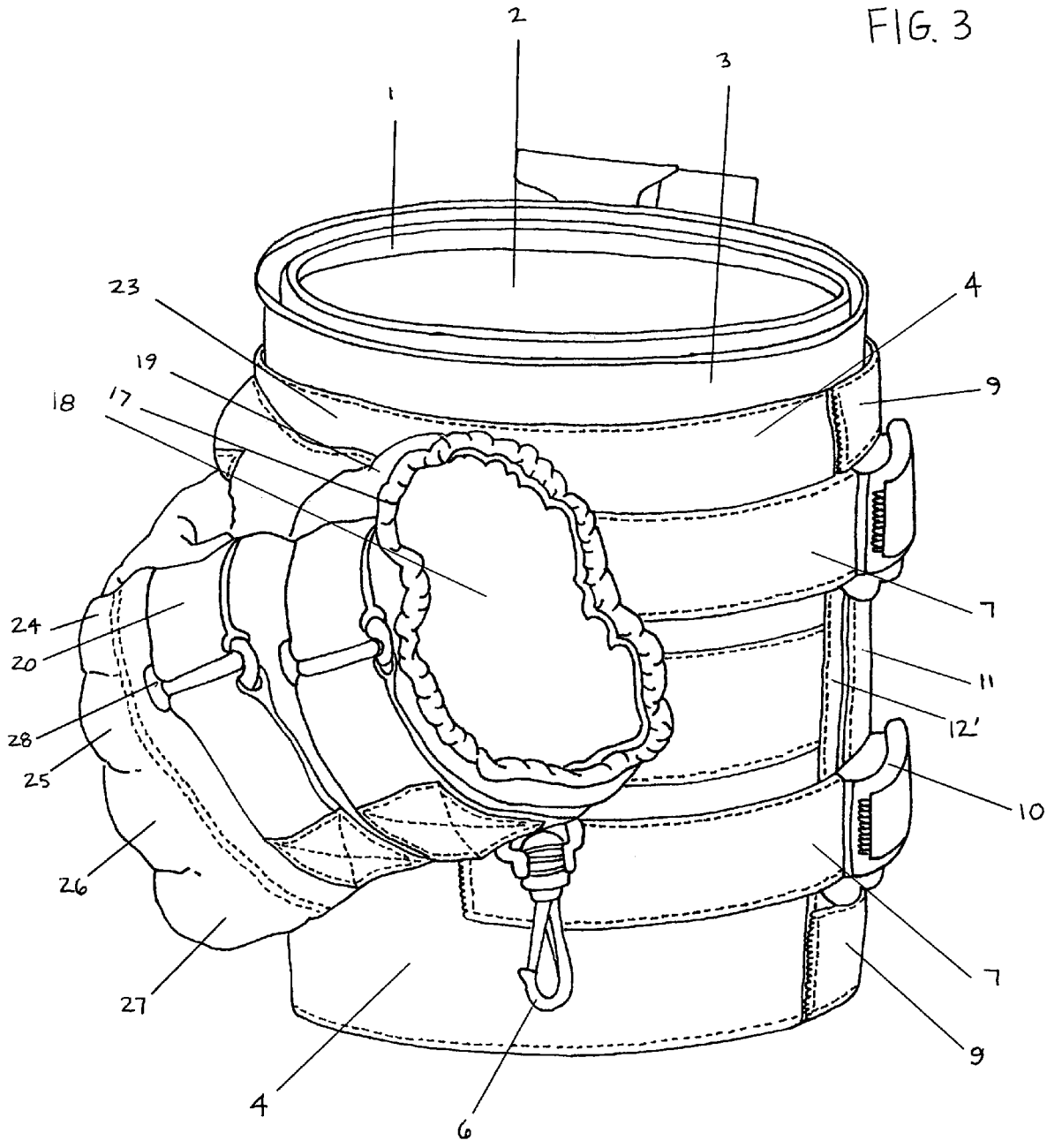
FIG. 3 shows a perspective view of the present invention but it shows a back angle of the glove attached to the sleeve, such sleeve covers the entire paint can, except for the top of the can. Also, shown are the two heavy duty adjustable straps for use in tightening the glove around a user's wrist.

With reference to FIG. 3, the invention comprises an elastic sleeve 4 that provides an opening at the top for receiving a bucket or paint can 1. The bucket or paint can 1 provides an opening 2 and the outside portion 3 of the bucket or paint can 1 fits against the inside area of the elastic sleeve 4. A swivel safety clip 6 is provided for hanging the apparatus up after use or hanging to the user's belt loop for carrying around. Heavy duty straps 7 which are about ¾ inches wide are also added to support the elastic sleeve 4. A heavy duty strap 9 which is about 1 inch wide is provided at the top and bottom of the elastic sleeve 4 at where the of the locking snap clips 8 (not shown in FIG. 3) are located. Female locking clips 10 are provided at the opposite end of the heavy duty straps 7 and mate with the locking snap clips 8 (not shown in FIG. 3). There is a glove attached to the elastic sleeve 4. There is an outside rim 17 of the glove, an opening 18 for the hand for the glove, and an outside wrist area 19 of the glove. Two heavy duty adjustable straps 20 which are about 1 inch wide are located at the back of the glove near the outside wrist area 19 of the glove. The glove has finger holes at 23, 24, 25, 26, and 27. At the wrist area of the glove is a strap loop 28 that allows the heavy duty adjustable straps 20 to be tightened or loosened for added support.

Figure 4:
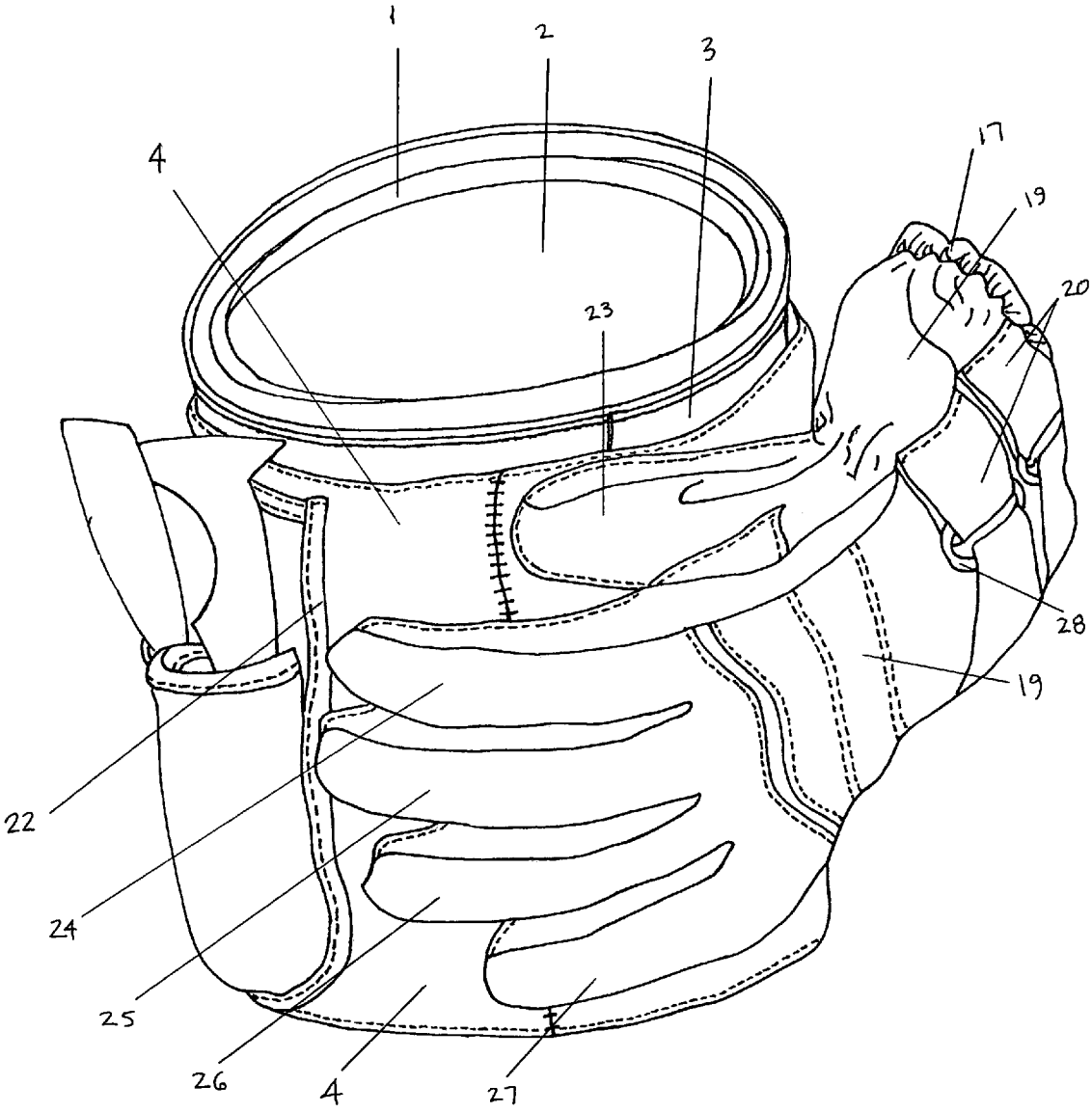
FIG. 4 shows a perspective view of the present invention but it shows a front angle of view of the entire glove attached to the sleeve, such sleeve covers the entire paint can, except for the top of the can.

With reference to FIG. 4, the invention comprises an elastic sleeve 4 that provides an opening at the top for receiving a bucket or paint can 1. The bucket or paint can 1 provides an opening 2 and the outside portion 3 of the bucket or paint can 1 fits against the inside area of the elastic sleeve 4 for carrying around. There is a glove attached to the elastic sleeve 4. There is an outside rim 17 of the glove and an outside wrist area 19 of the glove. Two heavy duty adjustable straps 20 which are about 1 inch wide are located at the back of the glove near the outside wrist area 19 of the glove. The glove has finger holes at 23, 24, 25, 26, and 27. At the wrist area of the glove is a strap loop 28 that allows the heavy duty adjustable straps 20 to be tightened or loosened for added support.

With reference to the drawings, then, regarding the use of the invention, in general, a painter would place a paint can 1 within the elastic sleeve 4. The elastic sleeve 4 would then be tightened by means of the heavy duty straps 7 that surround the elastic sleeve 4 by connecting the two locking snap clips 8 to the female locking clips 10. The painter would then place his fingers within the glove's finger holes at 23, 24, 25, 26, and 27. The painter would then tighten the wrist area of the glove by means of the two heavy duty adjustable straps 20. Three pouches, 14, 15, and 16 are provided on the elastic sleeve 4 for receiving the painter's tools. The painter would then use the subject invention. Once through, the two heavy duty adjustable straps 20 would be loosened and the two locking clips 8 to the female locking clips 10 would then be unclipped. The paint can 1 would then be removed from the elastic sleeve 4. The subject invention could then be put up or placed on the painter's clothes by means of the swivel safety clip 6 which is provided for hanging the apparatus up after use or hanging to the user's belt loop for carrying around.

With respect to the above description then, it is to be realized that the optimum dimensional relationships for the invention to include variations in size, materials, shape, form, function and manner of operation, assembly and use, are deemed readily apparent and obvious to one skilled in the art, and all equivalent relationships to those skilled in the art, and all equivalent relationships to those illustrated in the drawing and described in the specification are intended to be encompassed by the present invention.

Thus, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for holding a paint can, comprising:
a sleeve;
a glove attached to said sleeve;
at least one vertical strap attached vertically to said sleeve so as to add support to said sleeve;
at least one wrist strap surrounding said glove near the wrist area of said glove for tightening said glove around a user's wrist;
a means for holding said wrist strap;
at least one horizontal strap which surrounds said sleeve; and
a swivel safety clip attached to said glove.

2. The apparatus of claim 1, further comprising a pouch attached to said sleeve.

3. An apparatus for holding a paint can, comprising:
a sleeve;
a glove attached to said sleeve;
at least one vertical strap attached vertically to said sleeve so as to add support to said sleeve;
at least one wrist strap surrounding said glove near the wrist area of said glove for tightening said glove around a user's wrist;
a means for holding said wrist strap;
a means for securing said sleeve around the paint can wherein said securing means comprises at least one horizontal strap which surrounds said sleeve; and
a means to attach the apparatus to a user's clothes.

4. The apparatus of claim 3, further comprising a locking snap clip at one end of said horizontal strap and a female locking clip at the other end of said horizontal strap.

5. The apparatus of claim 3, wherein said means to attach the apparatus to a user's clothes is a swivel safety clip attached to said glove.

6. An apparatus for holding a paint can, comprising:
a sleeve;
a glove attached to said sleeve;
at least one vertical strap attached vertically to said sleeve so as to add support to said sleeve;
at least one wrist strap surrounding said glove near the wrist area of said glove for tightening said glove around a user's wrist;
a strap loop attached to said glove at the wrist area of said glove;
at least one horizontal strap having a locking snap clip at one end of said horizontal strap and a female locking clip at the other end of said horizontal strap, said horizontal strap surrounding said sleeve; and
a swivel safety clip attached to said glove.

7. The apparatus of claim 6, wherein said sleeve is elastic.

* * * * *